US005157941A

United States Patent [19]

Cur et al.

[11] Patent Number: 5,157,941

[45] Date of Patent: Oct. 27, 1992

[54] EVAPORATOR FOR HOME REFRIGERATOR

[75] Inventors: Nihat O. Cur, Royalton Township, Berrien County; Jeffrey J. Anselmino, Lincoln Township, Berrien County, both of Mich.

[73] Assignee: Whirlpool Corporation, Benton Harbor, Mich.

[21] Appl. No.: 669,040

[22] Filed: Mar. 14, 1991

[51] Int. Cl.[5] ..... F25D 11/02

[52] U.S. Cl. ..... 62/441; 62/515; 165/146

[58] Field of Search ..... 165/146, 147, 903; 62/515, 441

[56] References Cited

U.S. PATENT DOCUMENTS

| | | | |
|---|---|---|---|
| 2,200,502 | 5/1940 | Johnson | 62/419 |
| 2,384,313 | 9/1945 | Kohler | 62/103 |
| 2,912,834 | 11/1959 | Mann | 62/276 |
| 2,986,901 | 6/1961 | Hubacker | 62/276 |
| 2,991,048 | 7/1961 | Rabin | 62/515 |
| 3,012,760 | 12/1961 | McGrath | 165/146 |
| 3,267,692 | 8/1966 | Pfeiffer et al. | 62/515 |
| 3,745,786 | 7/1973 | Laughlin et al. | 62/419 |
| 3,834,176 | 9/1974 | Clarke | 62/276 |
| 4,545,428 | 10/1985 | Onishi et al. | 165/133 |
| 4,658,602 | 4/1987 | Giberson et al. | 62/515 |
| 4,776,178 | 10/1988 | Buchser | 62/156 |

*Primary Examiner*—Ronald C. Capossela

*Attorney, Agent, or Firm*—Thomas E. Turcotte; Stephen D. Krefman; Thomas J. Roth

[57] ABSTRACT

A tube and fin-type evaporator is provided for a refrigerator having trapezoidally shaped fins with the wider portion of the fins disposed upstream in the cooling air flow path through the evaporator. The refrigerant tube passes through at least two rows of openings in these fins, and those openings are staggered and of different length to enhance turbulence and reduce tube shielding within the cooling air flow. Projections (dimples) on the fins adjacent the downstream side of each opening are provided to reduce dead air space downstream from the tube. Further, the openings are provided with collars to increase heat transfer between the fins and the tube. These projections and collars also serve to increase rigidity of the fins. The present invention enables the use of relatively small diameter, thin walled refrigerant tubes within the evaporator. Also, the tubes can be hydraulically expanded within the fins to enhance fin to tube contact and decrease heat transfer resistance.

3 Claims, 3 Drawing Sheets

EVAPORATOR FOR HOME REFRIGERATOR

BACKGROUND OF THE INVENTION

The present invention refers generally to heat exchangers and, more specifically, to tube and fin-type evaporators for use in major appliances such as refrigerators.

Refrigerators typically include one or more enclosures or chambers for storing food or other articles to be cooled or frozen. The refrigerator housing about these enclosures includes two intersecting fluid circuits: a refrigerant circuit and a cooling air circuit. The refrigerant circuit includes a compressor, a condenser and an evaporator with tubing between these elements to permit the flow of the refrigerating fluid, Freon-12, for example. The cooling air circuit typically includes passageways for air to travel between the enclosures and the evaporator and an impeller, such as a fan, for causing the air to flow within the circuit. These two circuits intersect at the evaporator, which serves to enable the transfer of heat from the cooling air to the refrigerating fluid.

Evaporators for refrigerators typically include a tube and fin-type arrangement wherein a serpentine tube containing the refrigerating fluid passes through the evaporator, with air paths over the serpentine tube defined by the longitudinal length of these fins. One example of such a tube and fin-type evaporator is shown as element 16 of FIG. 3 in U.S. Pat. No. 3,745,786, issued Jul. 17, 1978 and also owned by the assignee of the present invention.

It has been found to be desirable to increase the efficiency of such tube and fin-type evaporators and to decrease the size of the evaporator. An evaporator can be made more compact by, for example, increasing the density of the fins and/or by increasing the inlet flow velocity of the cooling air. However, if fin density is increased, the normal frost build up on the fins can clog and close the flow passages for cooling air. To prevent this, more frequent defrosting is required. This defrosting, however, significantly increases energy consumption of the appliance. Similarly, increasing the flow velocity of the cooling air into the evaporator by, for example, increasing the fan speed not only consumes more energy but also increases the overall noise level of the appliance.

Other previous heat transfer enhancement methods have also been found to be disadvantageous when applied to refrigerators. For example, louvered or lanced fins are considered less effective than needed because of the relatively low flow velocities of cooling air in refrigerators and the frost build-up on the louvers.

Therefore, an object of the present invention is to provide an improved evaporator of more compact dimension and greater efficiency.

A further object is the provision of a refrigerator evaporator which uses less material in its construction without decreasing performance characteristics.

Another object is to provide an evaporator which minimizes the amount of refrigerant used in the refrigeration system and energy usage.

Yet another object is the provision of a tube and fin-type evaporator having improved heat transfer characteristics.

SUMMARY OF THE INVENTION

These and other objects of the present invention are obtained by the provision of a tube and fin-type evaporator for a refrigerator having trapezoidally shaped fins with the wider portion of the fins disposed upstream in the cooling air flow path through the evaporator. The refrigerant tube passes through at least two rows of openings in these fins, and those openings are staggered to enhance turbulence and reduce tube shielding within the cooling air flow. Projections (dimples) on the fins adjacent to the downstream side of each opening are provided to reduce dead air space downstream from the tube. Further, the openings through the fins are provided with collars to increase heat transfer between the fins and the tube. These projections and collars also serve to increase rigidity of the fins. The present invention enables the use of relatively small diameter, thin-walled refrigerant tubes within the evaporator. Also, the tubes can be hydraulically expanded within the fins to enhance fin-to-tube contact and decrease heat transfer resistance.

Other objects, advantages and novel features of the present invention will become readily apparent to those of skilled in the art upon consideration of the following detailed description and the attached drawings.

DESCRIPTION OF THE PREFERRED EMBODIMENTS

Figure 1:
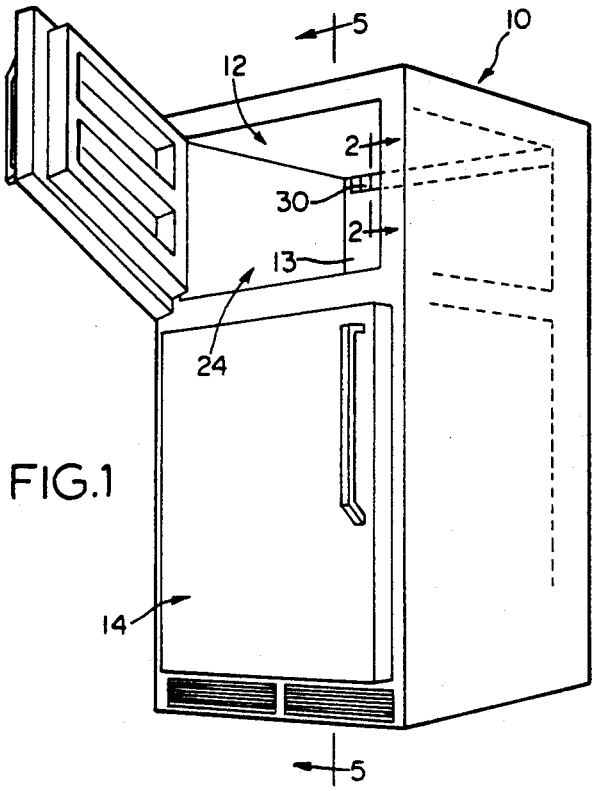
FIG. 1 shows a front, right perspective view of a household refrigerator of a type in which the present invention can be advantageously employed.

FIG. 1 illustrates a preferred application of the present invention within a household refrigerator appliance. It will be understood that the top mount refrigerator of FIG. 1 shows general features typically found in refrigerators and the preferred location of the present invention with respect to those features. Specifically, refrigerator 10 of FIG. 1 includes an upper enclosure 12 and a lower enclosure 14 for storing food or other articles to be cooled or frozen. Preferably, upper enclosure (freezer compartment) 12 is primarily for frozen food items and lower enclosure (refrigerating compartment) 14 is for cooled or refrigerated food items.

The refrigerant and cooling air circuits are also located within the housing of refrigerator 10. The refrigerant circuit includes a compressor 22, a condenser 20, an evaporator 24 and a sealed refrigerant system including tubes 26 for connecting these elements. Tubes 26 contain the refrigerant fluid, typically Freon-12. The portion of the refrigerator housing containing the condenser 20 may also include a condenser fan 28. Except as set forth herein these elements are normally found in refrigerators and are well understood by those skilled in the art.

Similarly, cooling air circuits are normally found in refrigerators, and the present invention does not contemplate modification of those circuits except as set forth herein. In general, previous cooling air circuits have fostered air flow from evaporator 24 through vents 30 into enclosure 12 for frozen items. A relatively small portion of the cooling air then typically gets diverted through an air duct 32 to enter refrigerator enclosure 14. The freezer portion of the cooling air returns to evaporator 24 through vents 34. Cooling air in refrigerator enclosure 14 returns to evaporator 24 through vents 36. A fan 38 is, for example, employed to serve as an impeller to cause movement of the cooling air within this circuit. The passageways between evaporator 24 and the vents of the cooling air circuit can be located and dimensioned according to the specific configuration desired for refrigerator 10. To avoid unnecessary complication the drawings of this application illustrate the passageways for the cooling air flow only in the vicinity of the evaporator.

Figure 2:
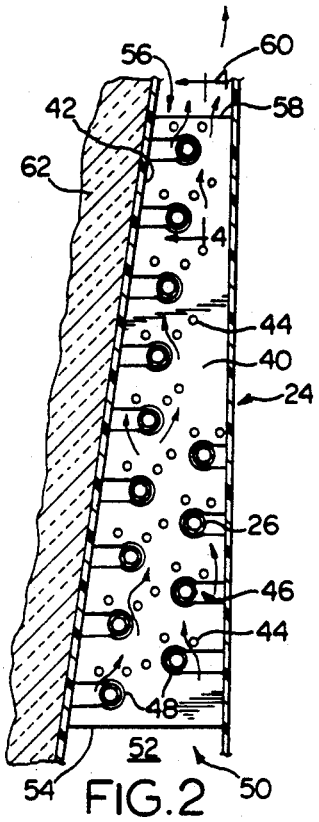
FIG. 2 shows an enlarged, cross-sectional view of an evaporator embodying the present invention as viewed along line 2—2 of FIG. 1.
Figure 4:
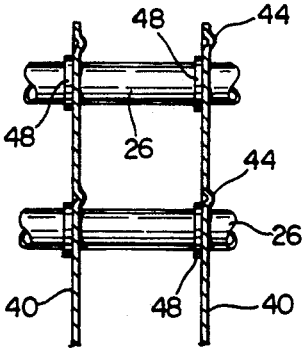
FIG. 4 shows an enlarged cross-sectional, fragmentary view along line 4—4 of FIG. 2.
Figure 3:
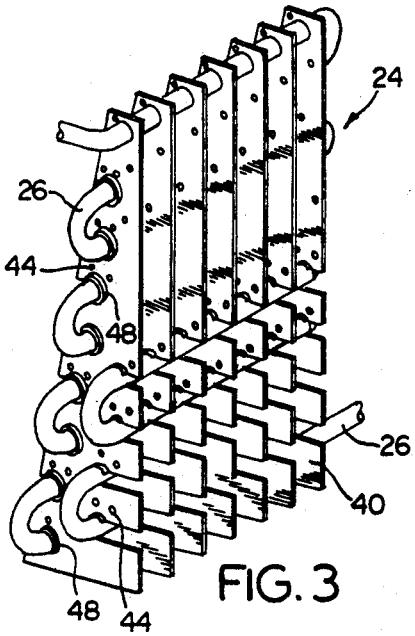
FIG. 3 shows a front, left perspective view of an abbreviated evaporator embodying the present invention as viewed apart from the refrigerator appliance.

As shown in FIGS. 2 and 3, evaporator 24 includes a plurality of fins 40 through which refrigerant tube 26 repeatedly passes in a serpentine path. This tube and fin arrangement is preferably mounted in a close fitting enclosure 42 which is open at either end to the cooling air circuit passageway or conduit. Each fin 40 is preferably wider at one end than at the other. As shown in the drawings, fins 40 are generally trapezoidal in shape and equally spaced apart and parallel, although the present invention also comtemplates embodiments where the fins are closer together at their narrow ends than at their wider ends.

As with prior tube and fin-type evaporators, fins 40 are preferably constructed from a heat conducting metal, such as aluminum, and are relatively thin compared to the length and width of tube 26 in evaportor 24. It should be understood, however, that as with some prior tube and fin-type evaporators, cooling air returning from enclosures 12 and 14 may be directed towards different portions of the evaporator 24 with different fin densities. For example, air returning from enclosure 14 should be directed toward the low fin density region of the evaporator in order to reduce frost clogging problems. In preferred embodiments of such segregated air flow arrangements the fin density on either side of the evaporator (for air returning from enclosure 14) could be four fins per inch while the fin density in the middle of the evaporator could be eight fins per inch (for air returning from enclosure 12).

Figure 8:
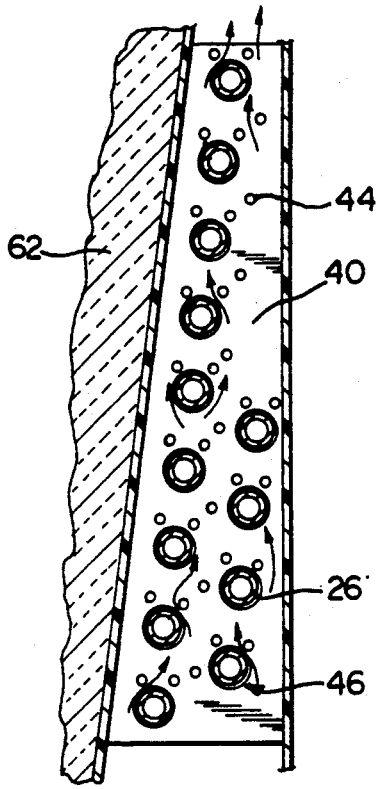
FIG. 8 shows an enlarged, cross-sectional view of an alternative embodiment of the present invention corresponding to the view of FIG. 2.

In addition to a tapering width, fins 40 differ from prior fins in the provision of projections or embossments 44 on the fin surface. These projections are, for example, formed with indentations on the opposite side of fins 40. The fins further include openings 46 for receiving tube 26. Preferably, a collar or flange 48 is provided on fin 40 adjacent each opening 46. These collars may, for example, be formed concurrently or subsequently to formation of openings 46 by various punching processes. In preferred embodiments, tube 26 is inserted via slots 45 into openings 46 such that a single length of tube 26 may be employed in evaporator 24. Slots 45 have a width less than the diameter of openings 46. An alternative embodiment is shown in FIG. 8 where no slots 45 are employed and, instead, multiple lengths of tubes 26 pass through fins 40 and are connected by return bands at each end.

The portion of tube 26 for the refrigerant fluid which passes through openings 46 in evaporator 24 is also preferably formed from heat conducting material, such as conventional metals. However, unlike previous devices the present invention employs relatively small diameter and thinner walled tubes for this purpose. For example, tube 26 in the disclosed evaporator 24 uses 5/16" diameter tubing instead of the ⅜" tubing normally used. Further, once tube 26 is inserted into all of openings 46 of fins 40, the tube is hydraulically expanded approximately 0.006" to lock the tube into fins 40. This hydraulic expansion provides more uniform and complete contact between tube 26 and fins 40, especially along flanges 48. Such improved contact has been found to reduce heat transfer resistance.

Figure 5:
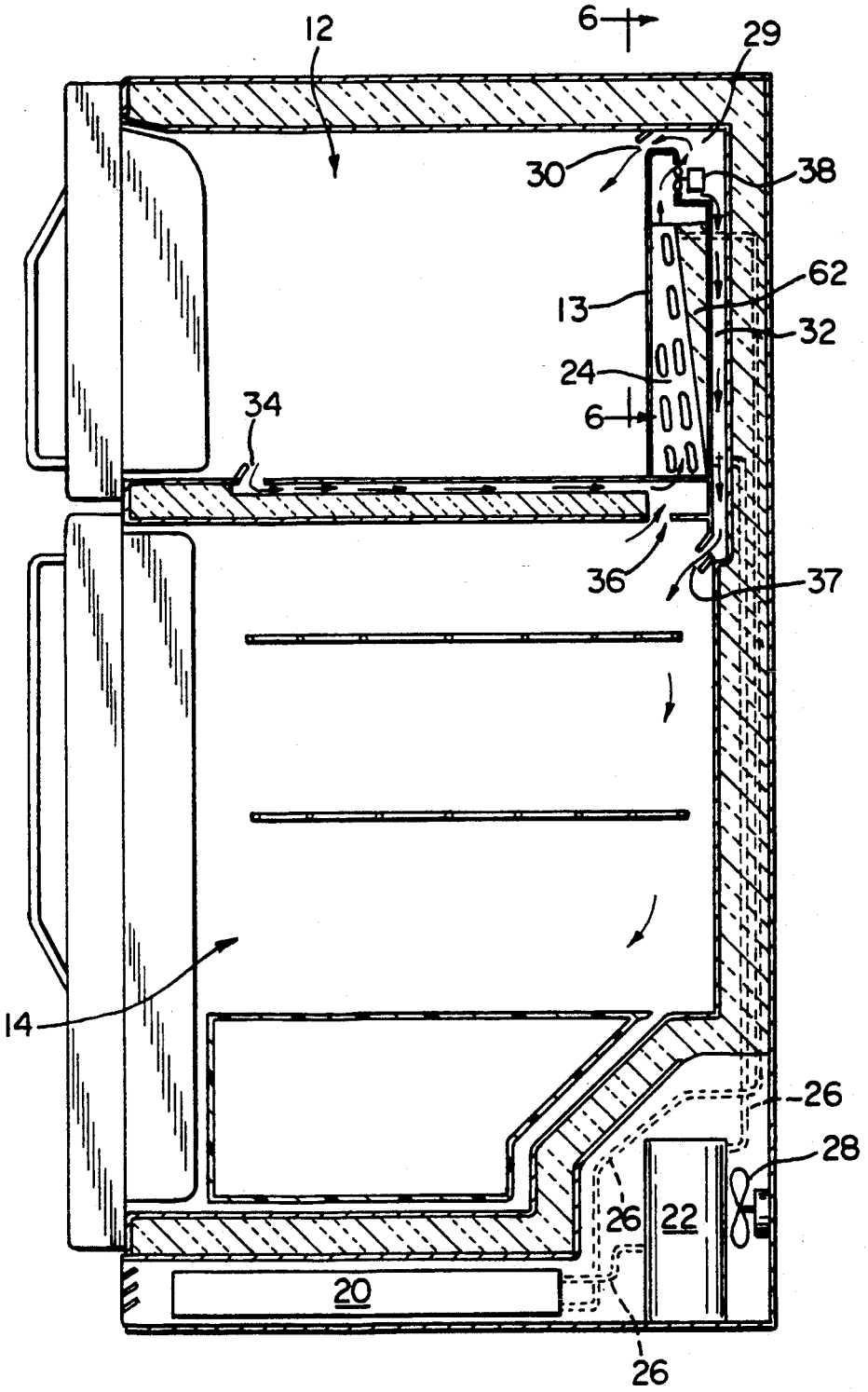
FIG. 5 shows a cross-sectional, schematic view along line 5—5 of FIG. 1.
Figure 6:
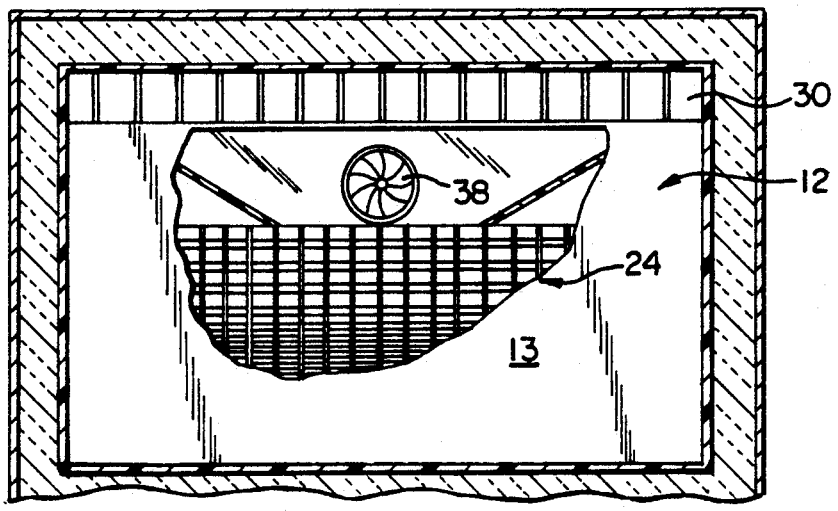
FIG. 6 shows a front view of the open freezer compartment of the refrigerator of FIG. 1 with a portion of the back wall therein broken away to reveal relative location of components of the present invention.

FIGS. 5 and 6 show in detail the location of the present invention with respect to the internal construction of a typical refrigerator. Specifically, evaporator 24 is preferably located behind back wall 13 of enclosure 12. Venting fan 38 may be located above and behind evaporator 24 to direct cooling air though passageway 29 to vents 30 and through air duct 32 to vents 37. Evaporator 24 preferably extends substantially the width of back wall 13, FIG. 3 being only an abbreviated version of that evaporator to show the location and relation of its elements.

Figure 7:
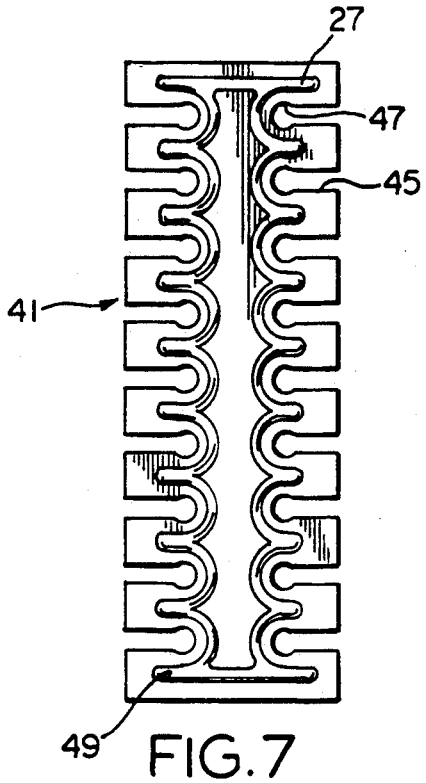
FIG. 7 PRIOR ART
FIG. 7 shows a side cross-sectional view of a fin found in a prior conventional tube and fin-type evaporators for comparative purposes.

FIG. 7 shows a side view of a conventional evaporator fin 41. As with the present invention, a plurality of openings 47 permit refrigerant tubing to pass through fin 41. Raised portions 49 extending about the edges of the fin are typically provided for fin rigidity. The present invention, however, uses relatively fewer openings and, thus, a shorter length of tube 46 may be used. Rather than use two parallel rows of an equal number of openings 47, the present invention employs a plurality of offset or staggered rows of openings 46 having significantly different numbers of openings 46. As shown, for example in FIG. 2, one row of openings would include four openings 46 and another row would include nine openings 46. Since openings 46 are preferably equispaced along a row, the row with more openings would extend further along the longitudinal length of fin 40. Preferably, this single row extension of openings 46 would occur at the narrower end of fin 40 which is downstream from cooling air flow. In preferred embodiments of the present invention, openings 46 from one row are also equi-spaced from openings 46 of adjacent rows. The present invention also contemplates that in certain embodiments more than two rows may be employed.

In operation, cooling air flow would enter evaporator enclosure 42 at inlet 50 from passageway 52 of the cooling air circuit. The wide end 54 of fin 40 is preferably disposed adjacent inlet 50, and enclosure 42 gradually narrows along the direction of cooling air flow until the cooling air leaves via outlet 56 and enters passageway 60 of the cooling air circuit. The narrow end 58 of fin 40 is preferably disposed adjacent outlet 56. In passing through enclosure 42 the velocity of the cooling air increases as the dimensions of the enclosure, as determined by the dimensions of fins 40, decrease.

Within enclosure 42 cooling air flows generally parallel to fins 40 and passes around tubes 26. The staggered arrangement of tubes 26 creates a more tortuous and turbulent path for the air flow and minimizes shielding of downstream portions of the tube by upstream portions since air flow is directed more around the tubes rather than merely past the tubes. Similarly, projections (dimples) 44 are disposed to direct air flow into the dead air space behind each tube, on its downstream side, on the side of the fin opposite flange 48. Specifically, projections 44 have been advantageously placed midway between the rows of openings 46 and immediately downstream and laterally outward from each opening 46. Projections 44 and collars 48 also serve to provide rigidity to the fins.

The present invention provides numerous specific advantages over prior devices. The air-to-fin heat transfer coefficient is enhanced by the greater velocity of the cooling air flow as it passes through enclosure 42. Thus, even though the heat transfer area of fins 40 decreases, the overall heat transfer performance can be held constant or improved with respect to prior evaporators. In addition, because velocity (and, thus, the heat transfer coefficient) is greater downstream, the present invention encourages more frost growth on the downstream portion of the fins than in prior devices. Further, the wider upstream end 54 of fins 40 tends to spread out upstream frost growth on the fins. The overall effect has been found to provide relatively more uniform frost growth on the components of evaporator 24. Thus, there is less potential for frost to block cooling air flow and possibly less frequent need for defrosting.

Smaller diameters for at least the portion of tube 26 within evaporator 24 also provides less air flow blockage and less potential for frost blockage of cooling air flow. Further, with less tube passes through fins 40 and thinner tubes (wall thicknesses can decrease with tube diameter) significant cost savings can be achieved in using less tube material. At the same time, the tube construction also increases the tube-to-refrigerant heat transfer coefficient so that overall heat transfer performance is maintainable even with less tube area in evaporator 24. Also, less refrigerant is needed because the shorter tube length and smaller diameter create a smaller internal volume.

The present invention also permits more compact construction of evaporator 24. Tapering of fins 40 in a trapezoidal shape and staggering of openings 46 permits narrow end 58 to be significantly narrower than prior fins (approximately 50%) without decreasing evaporator performance. Aside from using less fin material, this arrangement leaves more space for insulation 62 behind evaporator 24, especially at its upper end where the cooling air is coldest. This extra insulation can also contribute to decreased energy consumption by the appliance. The overall airside pressure drop through the narrowing fin passages of the present invention increases somewhat. However this can be readily offset by a slight modification to the fan 38 design. For example, the size of the fan blades may be slightly increased in such situations.

Although preferred embodiment of the present invention have been described above in detail, the same is by way of illustration and example only. Accordingly, the spirit and scope of this invention are limited only by the terms of the following claims.

What is claimed is:

1. In a refrigerator having means defining a freezer compartment and an above-freezing refrigerating compartment, an evaporator in said freezer compartment comprising: an enclosure for the evaporator, a tube and fin-type heat exchanger within the enclosure including a single serpentine fluid tube and a plurality of spaced parallel fins, generally trapezoidal in shape, mounted within the enclosure, the fins having a decreasing cross-sectional dimension generally parallel to the flow of cooling air through the evaporator for accelerating air flow through the evaporator, the fins having a series of tube openings in two or more spaced rows, with adjacent openings being connected to spaced open ended slots formed along edges of the fins to receive the single serpentine length of tube, and with fin flanges formed adjacent each opening, the tube being hydraulically expanded to lock the tube into complete contact with the fins and flanges thereof for improved heat transfer between the tube and the fins.

2. In a refrigerator as claimed in claim 1, wherein the fins include two or more projections disposed behind and laterally outward from each tube opening on its downstream side, to direct air flow into the dead air space behind each tube opening.

3. In a refrigerator as claimed in claim 2, wherein the projections are in the form of dimples formed on the fin providing rigidity for the fin, and the form of the dimples facilitates defrosting of the evaporator.

* * * * *